US009283766B2

(12) United States Patent
Kimura et al.

(10) Patent No.: US 9,283,766 B2
(45) Date of Patent: Mar. 15, 2016

(54) RECORDING APPARATUS

(71) Applicant: SEIKO EPSON CORPORATION, Tokyo (JP)

(72) Inventors: Naomi Kimura, Okaya (JP); Munehide Kanaya, Azumino (JP); Yoshisada Aoki, Azumino (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/531,714

(22) Filed: Nov. 3, 2014

(65) Prior Publication Data

US 2015/0130879 A1 May 14, 2015

(30) Foreign Application Priority Data

Nov. 12, 2013 (JP) ..... 2013-234196

(51) Int. Cl.
*B41J 2/175* (2006.01)

(52) U.S. Cl.
CPC ..... *B41J 2/17506* (2013.01)

(58) Field of Classification Search
CPC ..... B41J 2002/17573; B41J 2/17506; B41J 2/17509; B41J 2/17513
See application file for complete search history.

(56) References Cited

U.S. PATENT DOCUMENTS

| | | | | |
|---|---|---|---|---|
| 5,485,187 | A * | 1/1996 | Okamura et al. | 347/85 |
| 5,852,459 | A * | 12/1998 | Pawlowski et al. | 347/86 |
| 5,997,121 | A * | 12/1999 | Altfather et al. | 347/7 |
| 7,168,798 | B2 * | 1/2007 | Samii et al. | 347/86 |
| 7,210,772 | B2 * | 5/2007 | Sasaki | B41J 2/17513 347/86 |
| 7,510,274 | B2 * | 3/2009 | Davis et al. | 347/92 |
| 7,537,324 | B2 * | 5/2009 | Yamamoto | 347/86 |
| 2003/0079795 | A1 | 5/2003 | Allison | |
| 2010/0201759 | A1 * | 8/2010 | Kawase et al. | 347/85 |

FOREIGN PATENT DOCUMENTS

CN 2825289 10/2006

* cited by examiner

*Primary Examiner* — Stephen Meier
*Assistant Examiner* — John P Zimmermann
(74) *Attorney, Agent, or Firm* — Workman Nydegger

(57) ABSTRACT

An ink jet type printer including: a printing function section, a liquid ejecting head that is supported on a carriage movably disposed in the printing function section and performs recording by ejecting ink with respect to a paper sheet, and an ink supply tube that guides the ink of a main tank in which the ink is stored to the liquid ejecting head and has a deformation movable section capable of being deformed following movement of the carriage. The printing function section is provided with a filling port for filling the ink and the filling port and the main tank are connected through a connection pipe, a sub-tank, and an ink communication pipe.

16 Claims, 8 Drawing Sheets

RECORDING APPARATUS

BACKGROUND

1. Technical Field

The present invention relates to a recording apparatus, for example, an ink jet type printer and the like.

2. Related Art

In the related art, as a type of a recording apparatus, an ink jet type printer that performs printing (recording) by ejecting ink from a liquid ejecting head to a target such as a paper sheet is known. In such a printer, in order to supply the ink continuously and stably to the liquid ejecting head when performing a relatively large amount of printing, a configuration in which the ink is supplied from an ink tank (liquid storage section) of which a storage capacity of the ink is relatively large to the liquid ejecting head through an ink supply tube is proposed (for example, see Chinese Examined Utility Model Registration Application Publication No. CN 2825289Y).

In the printer having such a configuration, the liquid ejecting head is mounted on a carriage provided in a body housing (case) reciprocally with respect to the paper sheet in a main scanning direction. Then, the ink supply tube (liquid supply tube) extending from the ink tank disposed on a side surface of the body housing is inserted into a moving region of the carriage through an opening section on an upper side of the body housing and is connected to the liquid ejecting head mounted on the carriage.

However, in the printer described above, when replenishing the ink in the ink tank, usually, in order to fill the ink from a filling port of the ink provided in the ink tank, in consideration of workability for a user to fill the ink from the filling port, there is a problem that arrangement of the ink tank is limited.

Moreover, such a problem is not limited to the ink jet type printer and is generally common in a recording apparatus that performs recording by ejecting the liquid stored in the liquid storage section into which the liquid is directly filled from the filling port from the liquid ejecting head.

SUMMARY

An advantage of some aspects of the invention is to provide a recording apparatus in which replenishment of a liquid in a liquid storage section can be easily performed and a degree of freedom in arrangement of the liquid storage section can be improved.

Hereinafter, means of the invention and operation effects thereof will be described.

According to an aspect of the invention, there is provided a recording apparatus including: a case; a liquid ejecting head that is supported on a carriage movably disposed in the case and performs recording by ejecting a liquid with respect to a target; and a liquid supply tube that guides the liquid of a liquid storage section in which the liquid is stored to the liquid ejecting head and has a deformation movable section capable of being deformed following movement of the carriage. The case is provided with a filling port for filling the liquid. The filling port and the liquid storage section are connected through a connection section.

In this case, since the case is provided with the filling port for filling the liquid and the filling port and the liquid storage section are connected through the connection section, it is possible to replenish the liquid from the filling port provided in the case to the liquid storage section through the connection section regardless of the arrangement of the liquid storage section. Thus, it is possible to easily perform the replenishment of the liquid in the liquid storage section and to improve a degree of freedom in arrangement of the liquid storage section.

In the recording apparatus, it is preferable that the filling port be disposed in a front end portion of the case.

In this case, since the filling port is disposed in the front end portion of the case that is a position close to a user, the user can easily fill the liquid from the filling port.

In the recording apparatus, it is preferable that the filling port be disposed in a front side surface of the case.

In this case, since the filling port is disposed in the front side surface of the case that is a position close to the user, the user can easily fill the liquid from the filling port.

In the recording apparatus, it is preferable that the liquid storage section be provided with a replenishing port for replenishing the liquid, and the connection section connect the filling port and the replenishing port.

In this case, it is possible to easily assemble the liquid storage section and the connection section compared to a case where one end of the connection section is integrally formed with the liquid storage section.

In the recording apparatus, it is preferable that the connection section be provided with a buffer section that is capable of temporarily storing the liquid when the liquid is filled from the filling port.

In this case, if the liquid is filled from the filling port with a great force, since the momentum of the liquid is buffered by the buffer section, it is possible to prevent the liquid from overflowing from the filling port due to backflow of the liquid.

In the recording apparatus, it is preferable that the filling port be disposed at a position higher than that of the liquid storage section.

In this case, it is possible to guide the liquid filled from the filling port to the liquid storage section by gravity.

In the recording apparatus, it is preferable that the connection section extend such that a downstream side thereof is lower than an upstream side.

In this case, since the liquid in the connection section is guided to the liquid storage section by gravity, it is possible to suppress stagnation of the liquid in the connection section.

In the recording apparatus, it is preferable that the recording apparatus further include a sub-tank of which a height of a lower end is equal to a height of a lower end of the liquid storage section and a height of an upper end is equal to or greater than a height of an upper end of the liquid storage section, and which is capable of storing the liquid and from which a remaining amount of the liquid inside thereof may be visually recognized from the front side of the case, in which the lower end of the sub-tank communicates with the lower end of the liquid storage section.

In this case, since the height of the liquid surface in the liquid storage section is equal to the height of the liquid surface in the sub-tank, it is possible to ascertain the remaining amount of the liquid in the liquid storage section by the liquid surface of the sub-tank being visually recognized from the front side of the case.

In the recording apparatus, it is preferable that an air communication section allowing the inside of the liquid storage section to communicate with the atmosphere be provided in the upper end of the liquid storage section, and the liquid storage section and the sub-tank communicate with each other at a position higher than a liquid surface of the liquid inside thereof.

In this case, it is possible to open the inside of the sub-tank to the atmosphere by the air communication section of the liquid storage section.

In the recording apparatus, it is preferable that the recording apparatus further include a cover member that covers the filling port.

In this case, it is possible to prevent the liquid from volatilizing from the filling port or foreign matter from entering from the filling port by the cover member.

In the recording apparatus, it is preferable that the liquid storage section be disposed in the case.

In this case, it is possible to contribute to miniaturization of the recording apparatus.

In the recording apparatus, it is preferable that the liquid storage section be disposed so as not to overlap a transportation path of the target in a height direction of the case in the case.

In this case, it is possible to prevent an increase in the height of the case.

In the recording apparatus, it is preferable that a dam section that retains the liquid spilled from the filling port be provided with the case so as to surround the filling port.

In this case, if liquid is spilled from the filling port, since the spilled liquid is retained by the dam section, it is possible to prevent a periphery of the filling port from being contaminated by the spilled liquid from the filling port.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as an embodiment of a recording apparatus, an ink jet type printer that performs recording (printing) of an image containing characters, figures, or the like by ejecting ink as an example of a liquid on a paper sheet from a liquid ejecting head will be described with reference to the drawings.

Figure 1:
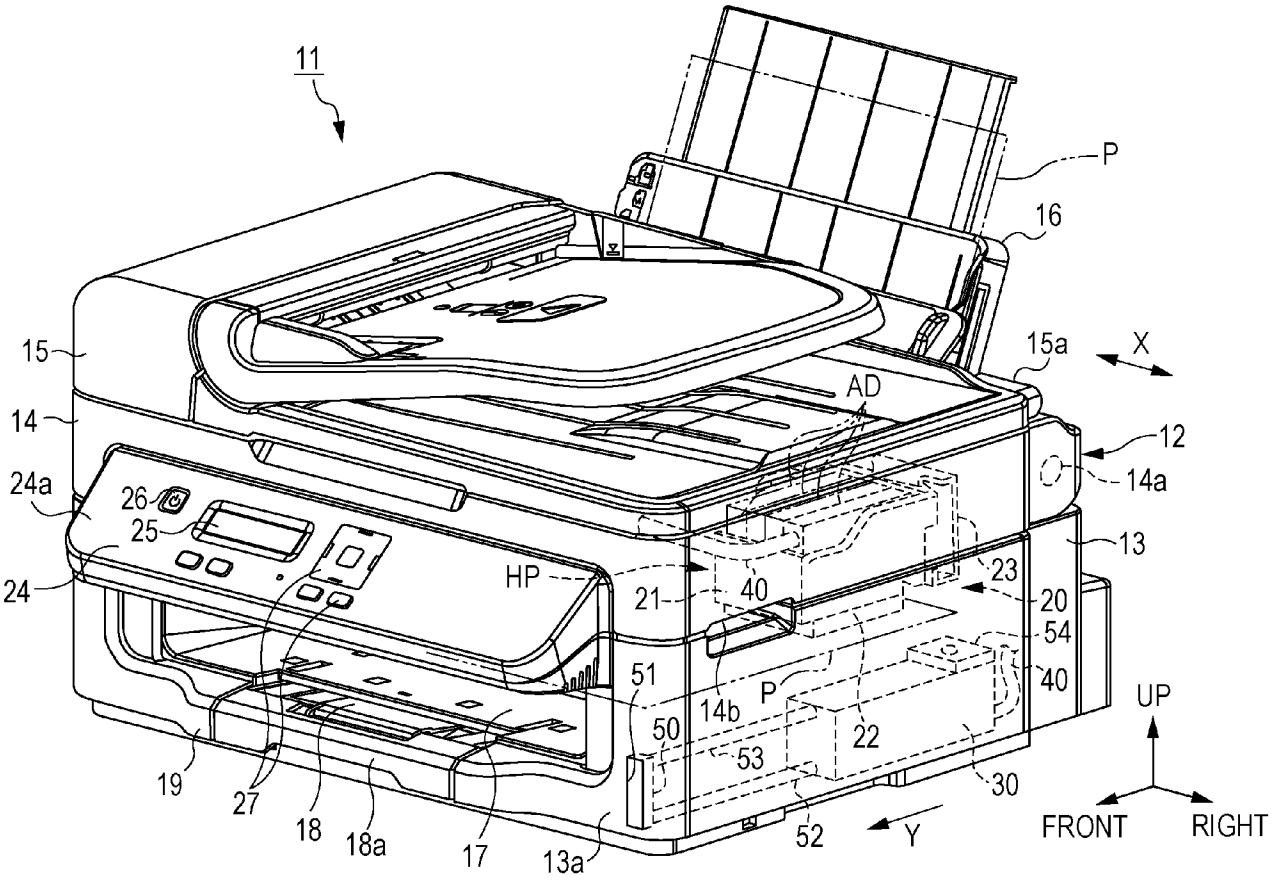
FIG. 1 is a perspective view of an ink jet type printer of an embodiment.

As illustrated in FIG. 1, an ink jet type printer 11 as an example of the recording apparatus includes an apparatus body 12 having a substantially rectangular parallelepiped shape. The apparatus body 12 includes a printing function section 13 having a substantially rectangular parallelepiped shape as an example of a case into which a printing section 20 is built on a side of a lower portion that is a gravity direction. In addition, the apparatus body 12 includes an image reading section 14 having a substantially rectangular parallelepiped shape as an example of a cover member in which an image reading mechanism such as a scanner that reads a document and the like is built on a side of an upper portion that is in a side opposite to the gravity direction.

The image reading section 14 is configured such that the image reading section 14 rotates about a rotation shaft 14*a* provided in one end (rear side) of the apparatus body 12 and the other end side (front side) opposite to the rotation shaft 14*a* is lifted in the apparatus body 12. That is, handhold sections 14*b* are recessed on side surfaces (both left and right side surfaces) of the image reading section 14 and a user can lift the image reading section 14 by holding the handhold sections 14*b* with the hands, for example, during maintenance.

Figure 2:
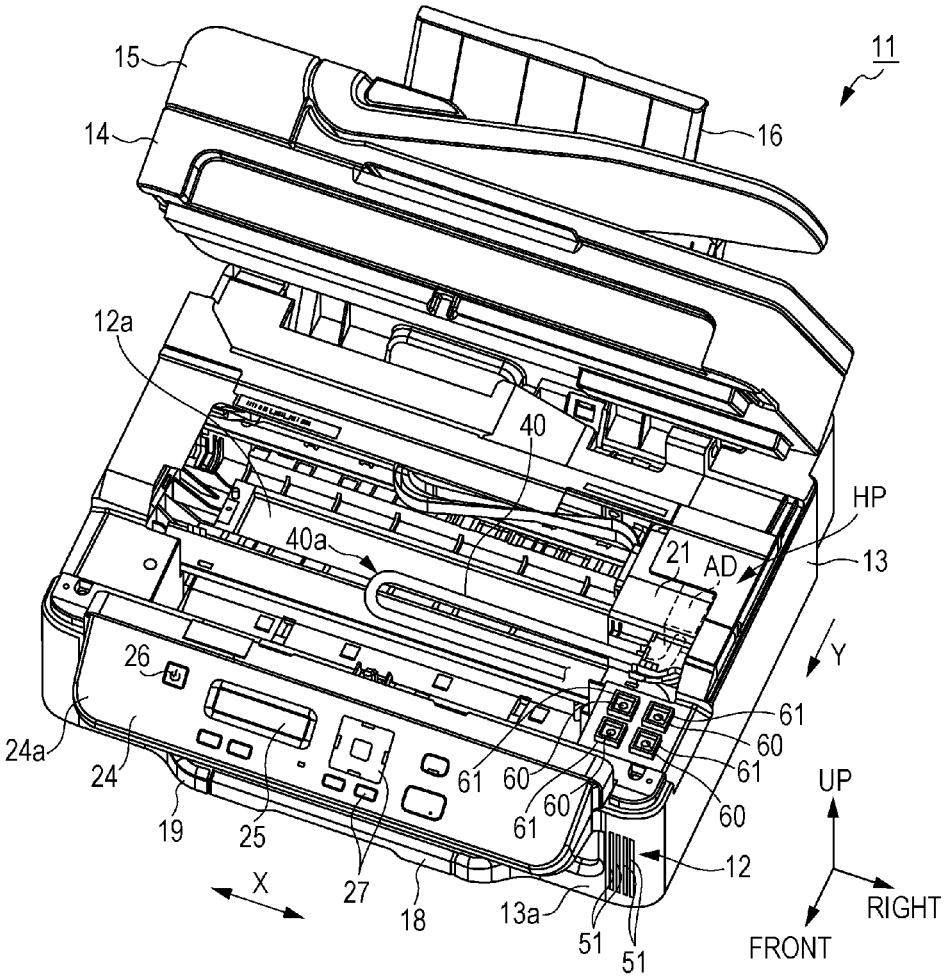
FIG. 2 is a perspective view illustrating a state when an image reading section is lifted in the printer.

Then, as illustrated in FIG. 2, an opening section 12*a* that exposes at least a part of a moving region of a carriage 21 reciprocally disposed in the printing function section 13 provided on the upper side of the printing section 20 is exposed by lifting the image reading section 14. That is, the image reading section 14 rotates about the rotation shaft 14*a* thereby opening and closing the opening section 12*a* of the printing function section 13.

As illustrated in FIGS. 1 and 2, an automatic document supply device 15 automatically supplying a reading document to the image reading section 14 is provided on the upper side of the image reading section 14. The automatic document supply device 15 is configured such that the automatic document supply device 15 rotates about a rotation shaft 15*a* provided in one end (rear side) of the apparatus body 12 and an end side (front side) opposite to the rotation shaft 15*a* is lifted in the apparatus body 12. The user can manually supply the reading document to the image reading section 14 by lifting the automatic document supply device 15.

Furthermore, a mounting stand 16 on which a plurality of stacked paper sheets P as an example of a target are capable of being mounted is provided on the rear side of the apparatus body 12. The paper sheets P mounted on the mounting stand 16 are printed by being transported to the printing section 20 provided in the printing function section 13 one by one from the rear side to the front side.

That is, the paper sheet P is transported from the mounting stand 16 to the printing section 20 by a transport mechanism (not illustrated) and is printed upon by ejecting the ink from a liquid ejecting head 22 supported on the carriage 21 that is reciprocated by a moving mechanism (not illustrated) along a main scanning direction X (lateral direction) orthogonal to a transportation direction Y (direction from the rear side to the front side) in the printing section 20. In this case, the carriage 21 is guided by a guide frame 23 extending along the main scanning direction X and is reciprocated in the main scanning direction X.

Then, the paper sheet P printed upon in the printing section 20 is further transported from the printing section 20 in transportation direction Y (front side) and is discharged from a paper discharge port 17 provided in the front surface of the apparatus body 12 (printing function section 13). A tray accommodation section 19 in which a stacker 18 for catching the paper sheet P discharged from the paper discharge port 17 is accommodated is formed on the lower side of the paper discharge port 17 in the apparatus body 12 (printing function section 13) so as to protrude in a discharging direction (here, transportation direction Y) of the paper sheet P.

The stacker 18 is easily drawn out from the apparatus body 12 by a gripping section 18*a* thereof and is drawn out from the apparatus body 12 depending on a length of the paper sheet P discharged from the paper discharge port 17 in the discharging direction (the transportation direction Y).

Furthermore, an operation panel section 24 allowing a printing operation and the like to be performed in the printing section 20 is provided on the upper side of the paper discharge port 17 in the apparatus body 12 (printing function section 13) so as to protrude to the front side that is the transportation direction Y. A surface on the upper side in the operation panel section 24 is an inclined surface 24*a* inclined so as to descend in the transportation direction Y. The inclined surface 24*a* is provided with a display section 25 for displaying a menu screen and the like, a power supply button 26, operation buttons 27 operated when performing printing, and the like.

Figure 3:
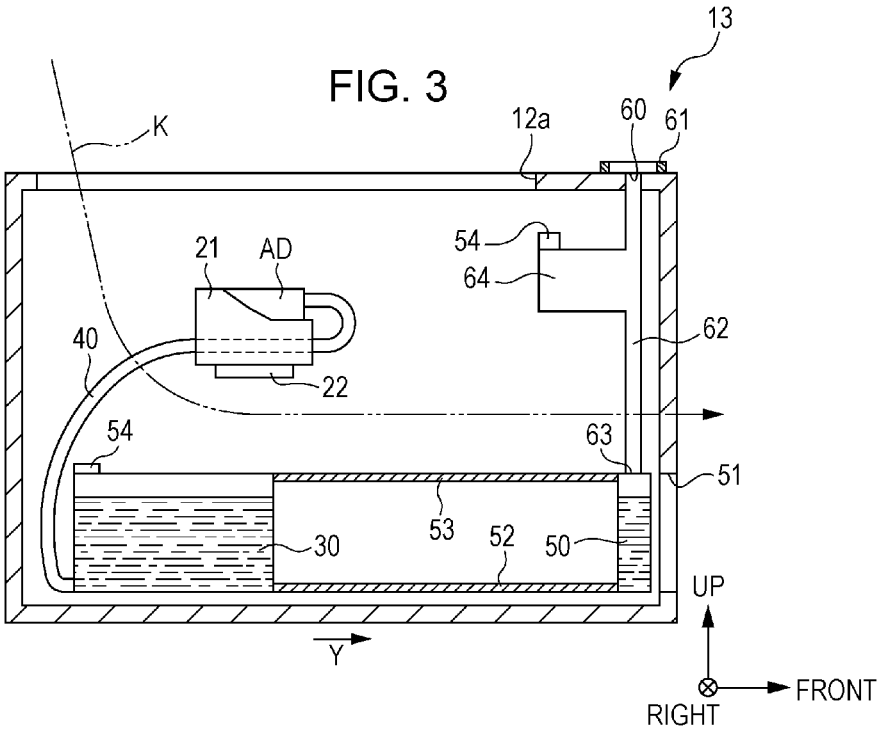
FIG. 3 is a schematic side cross-sectional view illustrating inside a printing function section of the printer.

As illustrated in FIGS. 1 and 3, a plurality (four in the embodiment) of main tanks 30 having a rectangular parallelepiped shape as an example of a liquid storage section storing the ink ejected from the liquid ejecting head 22 are disposed in a right rear end portion in a lower end portion of the printing function section 13. That is, the main tanks 30 are disposed at a position that is outside the moving region of the carriage 21 and a side of a home position HP in the main scanning direction X. Moreover, in FIG. 1, only one among four main tanks 30 is drawn in the printing function section 13 and the remaining three main tanks 30 are omitted.

A plurality (four in the embodiment) of relay adapters AD to which the other end of an ink supply tube 40 as an example of a liquid supply tube of which one end is connected to the main tank 30 is connected is mounted on the carriage 21. Each relay adapter AD relays the ink guided from each main tank 30 to the liquid ejecting head 22 by each ink supply tube 40. That is, the ink is supplied from each relay adapter AD mounted on the carriage 21 to the liquid ejecting head 22.

Furthermore, in the embodiment, four kinds of inks (for example, black ink, cyan ink, magenta ink, and yellow ink) are respectively supplied from each main tank 30. Of course, when supplying one kind of ink from one main tank 30 to the liquid ejecting head 22, only one relay adapter AD may be mounted on the carriage 21.

Moreover, as illustrated in FIG. 2, a portion in the ink supply tube 40, which is curved in a substantially U-shape along the main scanning direction X further on the front side (side of the operation panel section 24) than the moving region of the carriage 21 in the printing function section 13 functions as a deformation movable section 40*a* that is deformed following a reciprocating movement of the carriage 21 in the main scanning direction X.

Figure 4:
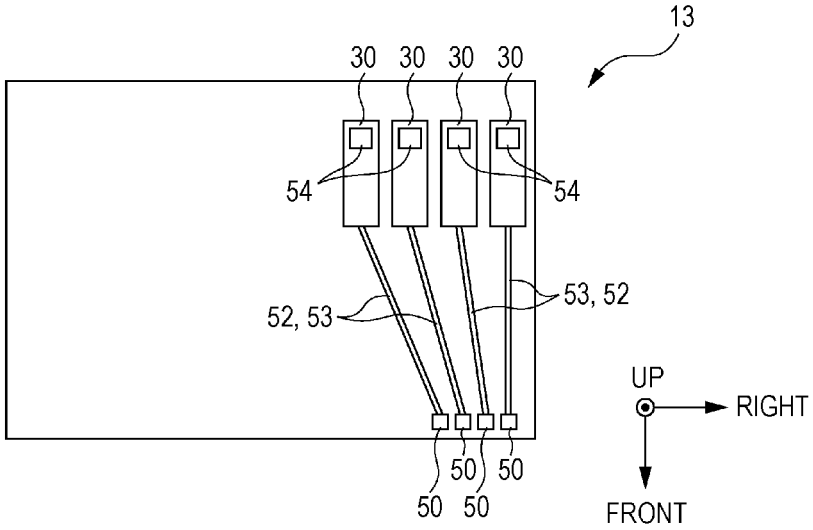
FIG. 4 is a schematic plan view illustrating an arrangement state of main tank inside the printing function section.

As illustrated in FIGS. 1, 3, and 4, a plurality (four in the embodiment) of sub-tanks 50 having a rectangular parallelepiped shape and capable of accommodating the ink are disposed in the right front end portion in the lower end portion in the printing function section 13. The four sub-tanks 50 respectively correspond to the four main tanks 30. Moreover, a volume of the sub-tank 50 is significantly smaller than a volume of the main tank 30.

The sub-tank 50 is formed of a transparent or semi-transparent synthetic resin so as to allow visual recognition the remaining amount of the ink inside thereof from the outside. The sub-tank 50 has a width in the main scanning direction X narrower than that of the main tank 30 and a width in the transportation direction Y narrower than that of the main tank 30. Furthermore, a height of the lower end and a height of the upper end of the sub-tank 50 are respectively equal to those of the main tank 30.

Furthermore, a viewing window 51 that is capable of allowing the remaining amount of the ink in the sub-tank 50 to be visually recognized from the outside of the printing function section 13 is formed at a position corresponding to each sub-tank 50 in a front surface 13*a* of the printing function section 13. In this case, the viewing window 51 may be sealed by fitting a transparent glass or a synthetic resin into the viewing window 51 so that dust and the like do not enter the printing function section 13 from the viewing window 51.

The lower end of the sub-tank 50 in a surface facing the main tank 30 communicates with the lower end of the main tank 30 in a surface facing the sub-tank 50 through an ink communication pipe 52. That is, the inside of the sub-tank 50 and the inside of the main tank 30 communicate with each other through the ink communication pipe 52 in the lower end thereof.

Meanwhile, the upper end of the sub-tank 50 in a surface facing the main tank 30 communicates with the upper end of the main tank 30 in a surface facing the sub-tank 50 through an air communication pipe 53. That is, the inside of the sub-tank 50 and the inside of the main tank 30 communicate with each other through the air communication pipe 53 at a position higher than a liquid surface when the inside hereof is filled with the ink.

The upper end surface of the main tank 30 is provided with an air communication section 54 for opening the inside of the main tank 30 to the atmosphere. The air communication section 54 has an ultrafine passage (not illustrated) communicating the inside and the outside of the main tank 30 and the passage meanders as a complicated labyrinth. Therefore, the air communication section 54 opens the inside of the main tank 30 to the atmosphere while preventing leakage of the ink inside of the main tank 30.

As illustrated in FIGS. 2 and 3, a plurality (four in the embodiment) of filling ports 60 for filling the ink are formed in the right front end portion (front end portion in the end portion on the side of the home position HP of the carriage 21) in the upper surface of the printing function section 13. The four filling ports 60 respectively correspond to four sub-tanks 50. In this case, the filling port 60 is disposed at a position higher than the main tank 30. Generally, the filling port 60 is covered by the image reading section 14. Then, the filling port 60 is open and closed by rotation of the image reading section 14.

Furthermore, a dam section 61 retaining the ink spilled from each filling port 60 protrudes in the upper surface of the printing function section 13 so as to surround each filling port 60. The filling port 60 is connected to a replenishing port 63 formed on the upper surface of the sub-tank 50 through a connection pipe 62 as an example of the connection section. Thus, the filling port 60 is connected to the main tank 30 through the connection pipe 62, the sub-tank 50, and the ink communication pipe 52.

For example, the connection pipe 62 is configuration of a flexible tube. A buffer section 64 temporarily storing the filled ink when filling the ink from the filling port 60 is provided in the vicinity of the filling port 60 in an intermediate position of the connection pipe 62. The buffer section 64 has a volume significantly larger than that of the connection pipe 62 and the upper end surface thereof is provided with the air communication section 54 opening the inside of the buffer section 64 to the atmosphere. For example, the buffer section 64 is configured of a hard synthetic resin and the connection pipe 62 is connected to an upstream side and a downstream side of the buffer section 64.

Furthermore, the connection pipe 62 extends such that the downstream side is lower than the upstream side of the ink. That is, the connection pipe 62 extends so as to be gradually lowered from the filling port 60 to the sub-tank 50. Moreover, an arrow indicated by a two-dotted chain line in FIG. 3 represents a transportation path K of the paper sheet P.

Next, an operation when replenishing the main tank 30 of the ink jet type printer 11 with the ink will be described.

Then, when replenishing the main tank 30 with the ink, first, the user lifts the image reading section 14 while rotating the image reading section 14 and thereby the filling port 60 formed in the right front end portion in the upper surface of the printing function section 13 is exposed. Subsequently, the user fills the ink into the filling port 60. At this time, even if the ink is spilled from the filling port 60, since the spilled ink can be retained by the dam section 61, it is possible to prevent a periphery of the filling port 60 from being contaminated by the ink.

Then, the ink filled from the filling port 60 flows inside the connection pipe 62 and is temporarily stored in the buffer section 64, and then flows inside the connection pipe 62 and flows into the sub-tank 50 from the replenishing port 63. At this time, even if the ink is filled with a great force from the filling port 60, since the filled ink is temporarily stored in the buffer section 64, it is possible to prevent overflow of the ink from the filling port 60 due to backflow of the ink.

Then, the ink flowing into the sub-tank 50 flows into the main tank 30 through the ink communication pipe 52. In this case, the sub-tank 50 and the main tank 30 communicate with each other between the lower ends thereof via the ink communication pipe 52. Since the inside of the main tank 30 and the inside of the sub-tank 50 are open to the atmosphere via the air communication section 54 provided in the main tank 30, the heights of the liquid surfaces of the ink inside of the main tank 30 and the inside of the sub-tank 50 are equal to each other.

At this time, it is possible to ascertain the amount of the ink inside of the main tank 30 by the liquid surface of the ink inside of the sub-tank 50 being visually recognized from the viewing window 51 of the front surface 13*a* of the printing function section 13 by the user. Thereafter, the user fills the ink from the filling port 60 until the ink fills up the main tank 30 while confirming the amount of the ink inside of the main tank 30 from the viewing window 51 and thereby the replenishing operation of the ink in the main tank 30 is completed.

As described above, since the ink can be replenished from the filling port 60 formed in the right front end portion in the upper surface of the printing function section 13 to the main tank 30 regardless of the arrangement of the main tank 30, it is possible to easily replenish the ink to the main tank 30 and to improve a degree of freedom in arrangement of the main tank 30.

In this connection, if the filling port 60 is provided in the main tank 30, since the replenishment of the ink is different by the arrangement of the main tank 30, the arrangement of the main tank 30 is significantly limited.

Above, according to the described embodiment, it is possible to obtain the following effects.

(1) The filling port 60 provided in the printing function section 13 is connected to the main tank 30 through the connection pipe 62, the sub-tank 50, and the ink communication pipe 52. Thus, it is possible to replenish the main tank 30 with the ink from the filling port 60 through the connection pipe 62, the sub-tank 50, and the ink communication pipe 52 regardless of the arrangement of the main tank 30. Thus, it is possible to easily perform the replenishment of the ink in the main tank 30 and to improve the degree of freedom in arrangement of the main tank 30.

(2) Since the filling port 60 is disposed in the right front end portion in the upper surface of the printing function section 13 that is a position close to the user, the user can easily fill the ink from the filling port 60.

(3) The buffer section 64 temporarily storing the ink when filling the ink from the filling port 60 is provided in the intermediate position of the connection pipe 62. Thus, if the ink is filled from the filling port 60 with a great force, since the momentum of the ink is buffered by the buffer section 64, it is possible to prevent the ink from overflowing from the filling port 60 due to backflow of the ink.

(4) Since the filling port 60 is disposed at a position higher than the main tank 30, it is possible to guide the ink filled from the filling port 60 to the main tank 30 by gravity.

(5) The connection pipe 62 extends such that the downstream side is lower than the upstream side of the ink. Thus, since the ink inside of the connection pipe 62 is guided to the main tank 30 by gravity, it is possible to prevent the ink from stagnating in the connection pipe 62.

(6) The heights of the upper end and the lower end of the sub-tank 50 are respectively equal to the heights of the upper end and the lower end of the main tank 30 and the lower end of the sub-tank 50 and the lower end of the main tank 30 communicate with each other through the ink communication pipe 52, and the remaining amount of the ink inside of the sub-tank 50 can be visually recognized from the viewing window 51 of the front surface 13*a* of the printing function section 13. Thus, since the height of the liquid surface of the ink inside of the main tank 30 and the height of the liquid surface of the ink inside of the sub-tank 50 are equal to each other, it is possible to easily ascertain the remaining amount of the ink inside of the main tank 30 by the liquid surface of the ink of the sub-tank 50 being visually recognized from the viewing window 51 of the front surface 13*a* of the printing function section 13.

(7) The upper end of the main tank 30 is provided with the air communication section 54 communicating the inside the main tank 30 with the atmosphere and the main tank 30 and the sub-tank 50 communicate with each other through the air communication pipe 53 at a position higher than the liquid surface of the ink inside thereof. Thus, it is possible to open the inside of the sub-tank 50 to the atmosphere by the air communication section 54 of the main tank 30. In this connection, since the size of the sub-tank 50 is significantly smaller than that of the main tank 30, it is difficult to provide the air communication section 54 having a certain degree of size in the sub-tank 50.

(8) Since the filling port 60 is covered by the image reading section 14, it is possible to prevent the ink from volatilizing from the filling port 60 or foreign matter from entering from the filling port 60 by the image reading section 14.

(9) Since the main tank 30 is disposed inside the printing function section 13, it is possible to contribute to miniaturization of the ink jet type printer 11.

(10) The dam section 61 retaining the ink spilled from the filling port 60 is provided on the upper surface of the printing function section 13 so as to surround the filling port 60. Thus, if the ink is spilled from the filling port 60, since the spilled ink is retained by the dam section 61, it is possible to prevent the periphery of the filling port 60 from being contaminated by the spilled ink from the filling port 60.

(11) When designing the ink jet type printer 11, if the position (for example, a dead space and the like inside the printing function section 13) of the main tank 30 is determined and then the position of the filling port 60 is determined, it is possible to prevent the length of the connection pipe 62 from being lengthened.

(12) When designing the ink jet type printer 11, if the position of the filling port 60 is determined and then the position of the main tank 30 is determined, it is possible to improve workability when filling the ink from the filling port 60.

Modification Example

Moreover, the above embodiments may be modified as below.

Figure 5:
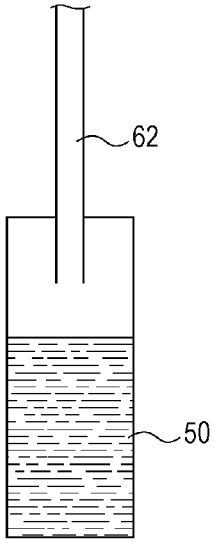
FIG. 5 is a schematic view illustrating a state where a connection pipe and a sub-tank are integrally formed in a modification example.

As illustrated in FIG. 5, the replenishing port 63 may be omitted from the sub-tank 50 and the connection pipe 62 and the sub-tank 50 may be integrally formed and thereby a leading end of the connection pipe 62 may be disposed inside the sub-tank 50.

Figure 6:
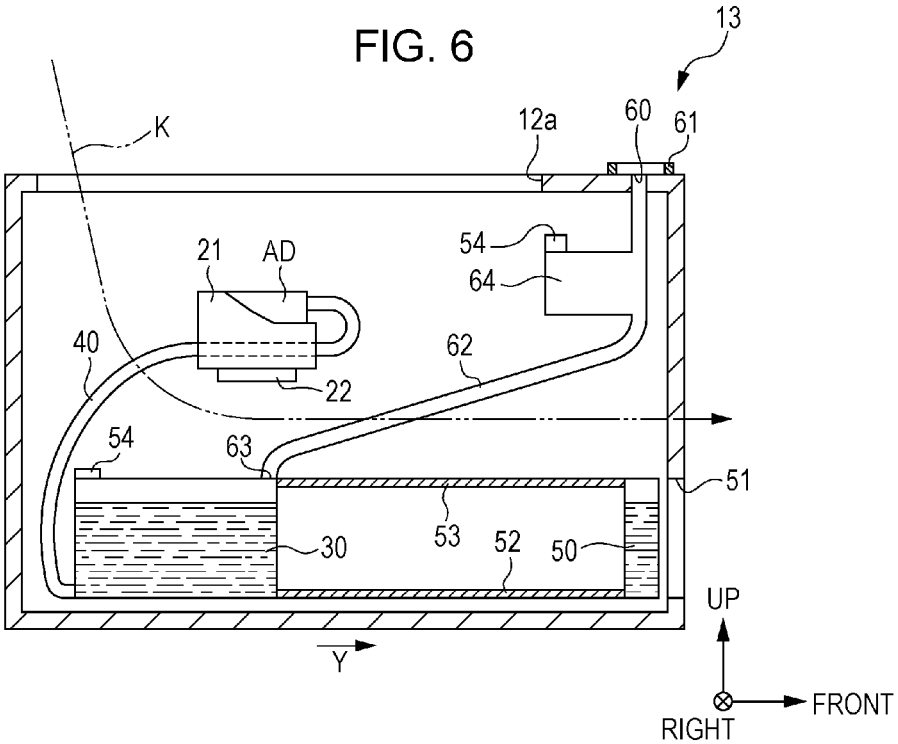
FIG. 6 is a schematic side cross-sectional view illustrating inside a printing function section of a printer of a modification example.
Figure 7:
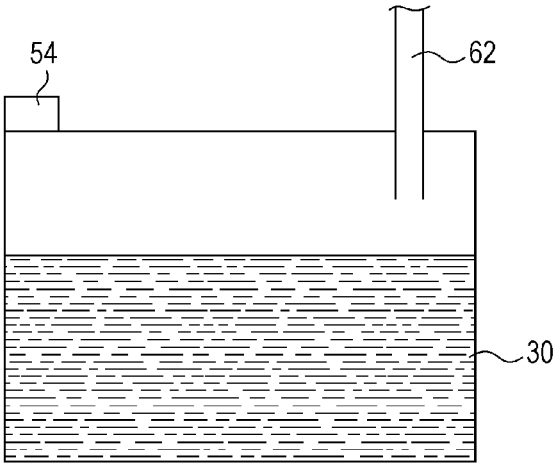
FIG. 7 is a schematic view illustrating a state where a connection pipe and a main tank are integrally formed in a modification example.

As illustrated in FIG. 6, the replenishing port 63 may be provided on the upper surface of the main tank 30 and the other end of the connection pipe 62 of which one end is connected to the filling port 60 may be connected to the replenishing port 63 of the main tank 30. In this way, it is possible to easily assemble the main tank 30 and the connection pipe 62 inside the printing function section 13 compared to a case where the other end of the connection pipe 62 is integrally formed with the main tank 30. Furthermore, in this case, as illustrated in FIG. 7, the replenishing port 63 is omitted from the main tank 30 and the connection pipe 62 and the main tank 30 may be integrally formed and thereby the leading end of the connection pipe 62 is disposed inside the main tank 30.

Figure 8:
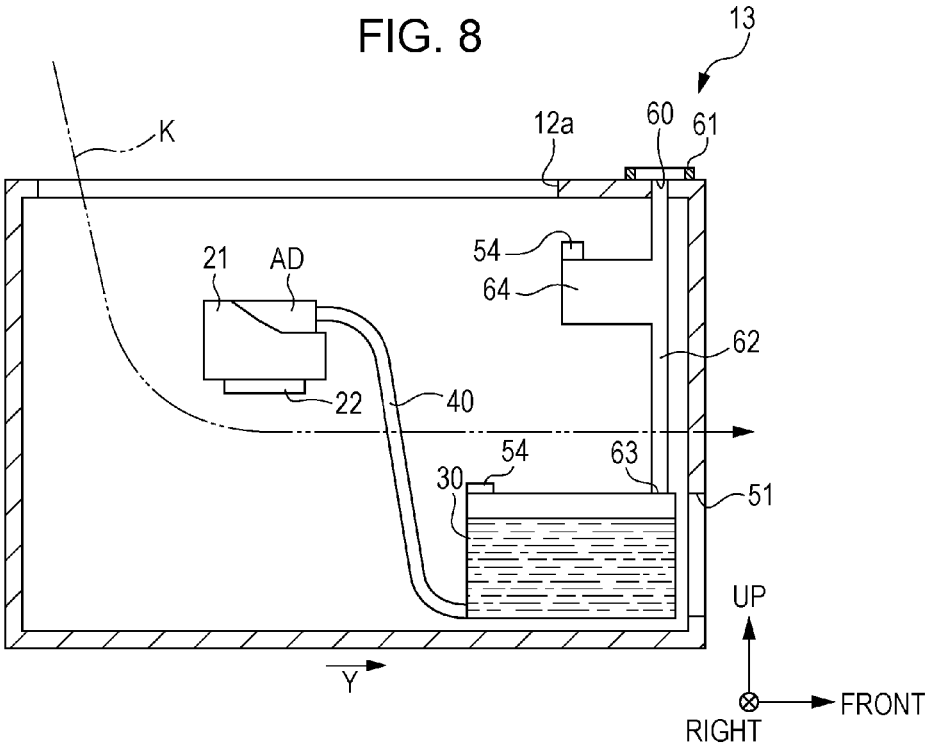
FIG. 8 is a schematic side cross-sectional view illustrating inside a printing function section of a printer of a modification example.

As illustrated in FIG. 8, the sub-tank 50 may be omitted, the main tank 30 may be disposed in the position of the sub-tank 50, the replenishing port 63 may be provided on the upper surface of the main tank 30, and the other end of the connection pipe 62 of which one end is connected to the filling port 60 may be connected to the replenishing port 63 of the main tank 30. In this case, if the main tank 30 is configured of a transparent or semi-transparent synthetic resin and the liquid surface of the ink inside of the main tank 30 can be visually recognized from outside of the main tank 30, the user can visually recognize the liquid surface of the ink inside of the main tank 30 from the viewing window 51 of the front surface 13*a* of the printing function section 13.

Figure 9:
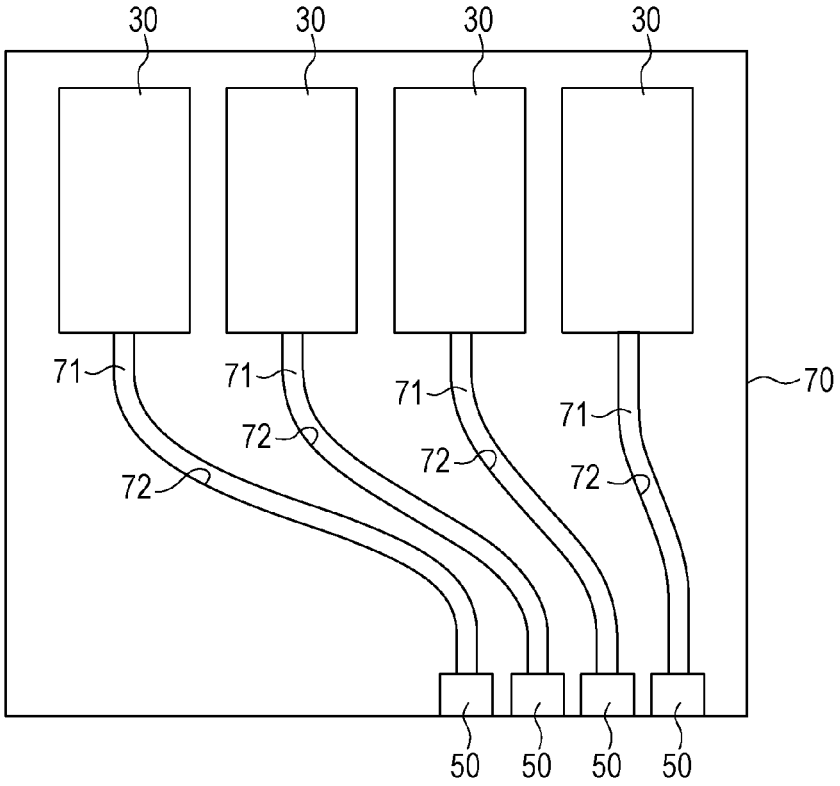
FIG. 9 is a schematic plan view illustrating a state where a main tank and a sub-tank communicate with each other in a modification example.
Figure 10:
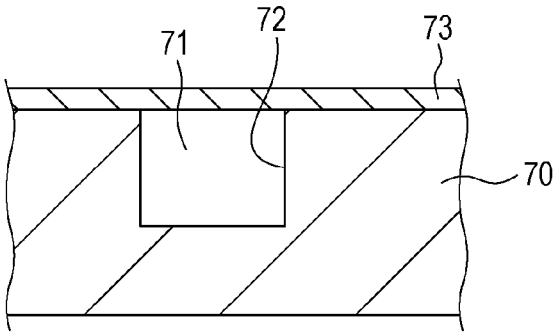
FIG. 10 is an enlarged cross-sectional view of a main portion of FIG. 9.
Figure 11:
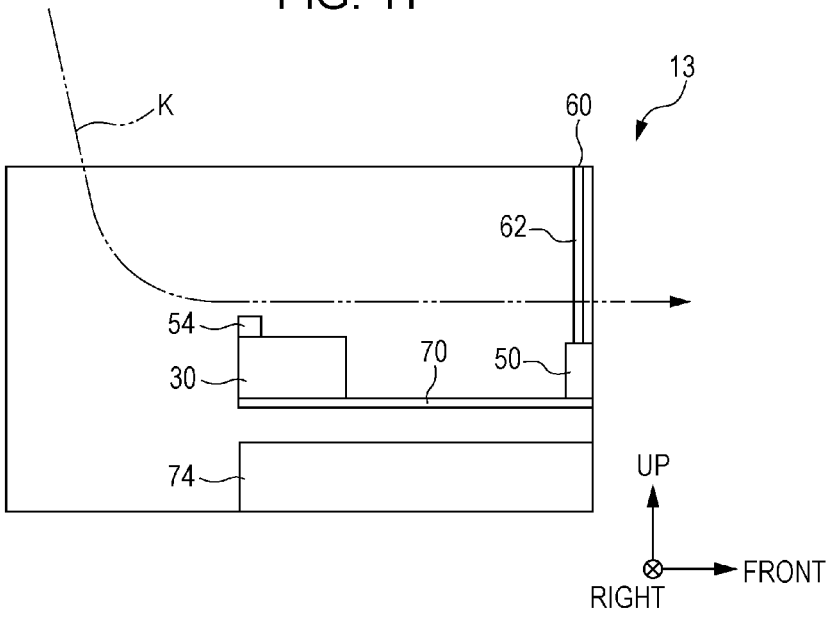
FIG. 11 is a schematic side view illustrating inside a printing function section of a printer of a modification example.
Figure 12:
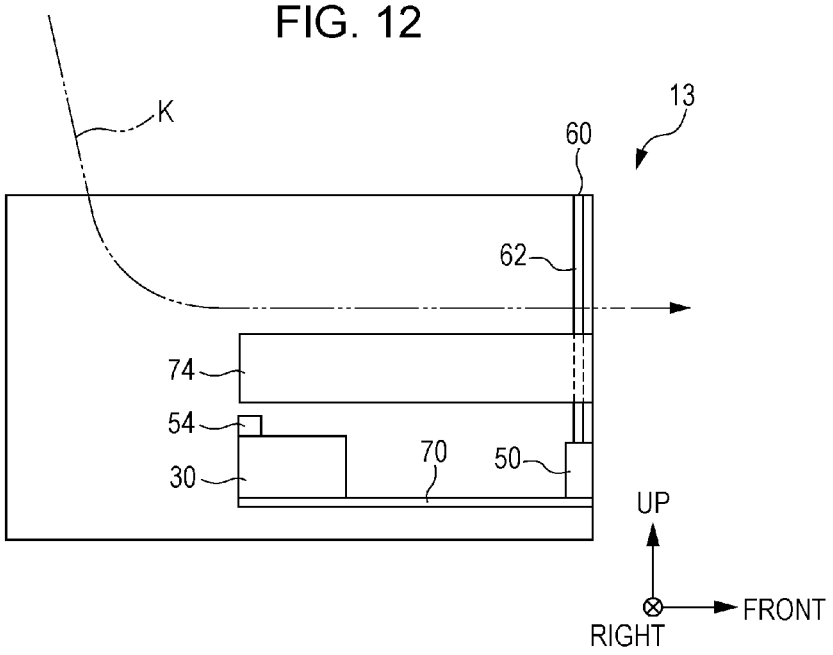
FIG. 12 is a schematic side view illustrating inside a printing function section of a printer of a modification example.

As illustrated in FIG. 9, the main tank 30 and the sub-tank 50 may be disposed on a plate 70 and the inside of the main tank 30 and the inside of the sub-tank 50 may communicate with each other via a flow path 71 formed on the plate 70. In this case, as illustrated in FIG. 10, the flow path 71 is configured of a groove 72 formed on the plate 70 and a film 73 that is welded to the plate 70 so as to seal an opening of the groove 72. As illustrated in FIG. 11, if a paper sheet cassette 74 storing the paper sheet P is disposed further on the lower side than the transportation path K of the paper sheet P inside the printing function section 13, the main tank 30 and the sub-tank 50 of an aspect being disposed on the plate 70 may be disposed between the transportation path K of the paper sheet P inside the printing function section 13 and the paper sheet cassette 74. Otherwise, as illustrated in FIG. 12, the main tank 30 and the sub-tank 50 of the aspect being disposed on the plate 70 may be disposed further on the lower side than the paper sheet cassette 74 inside the printing function section 13.

Figure 13:
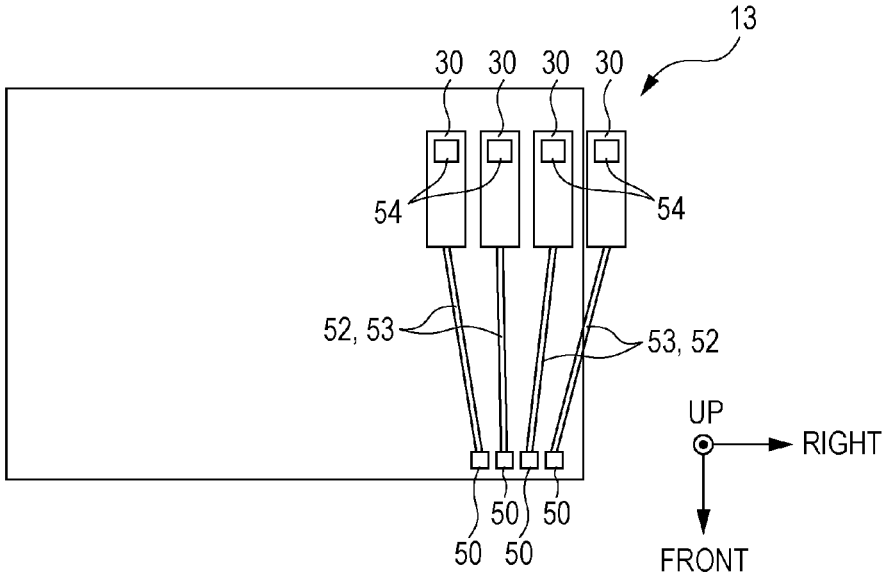
FIG. 13 is a schematic plan view illustrating an arrangement state of a main tank in a printer of a modification example.

As illustrated in FIG. 13, for example, at least one (for example, only one) of four main tanks 30 may be disposed outside the printing function section 13.

Figure 14:
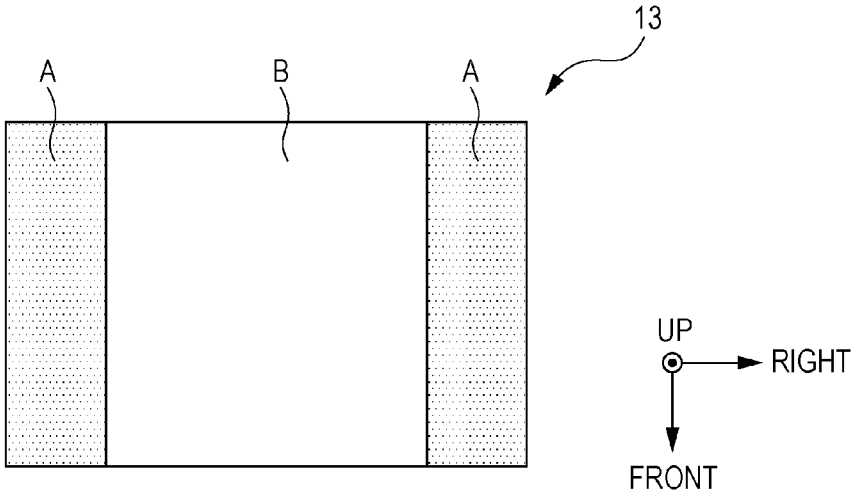
FIG. 14 is a schematic plan view illustrating a region in a printing function section of a printer of a modification example.

As illustrated in FIGS. 11 and 14, when regions of both left and right end portions inside the printing function section 13 are regions A and a region of the center portion is a region B, the main tank 30, the sub-tank 50, and the filling port 60 may be disposed in the regions A and the transportation path K of the paper sheet P and the paper sheet cassette 74 may be disposed in the region B. That is, the main tank 30 and the sub-tank 50 may be disposed so as not to overlap the transportation path K of the paper sheet P and the paper sheet cassette 74 in the height direction (vertical direction) of the printing function section 13 inside the printing function section 13. In this way, it is possible to prevent the height of the printing function section 13 from increasing and it is possible to prevent the height of the ink jet type printer 11 from increasing. Furthermore, in this case, it is preferable that the main tank 30, the sub-tank 50, and the filling port 60 be disposed by two in the left and right regions A.

Each main tank 30 may be intensively disposed on a side on which a few driving system is disposed inside the printing function section 13.

A maintenance section performing maintenance such as cleaning of the liquid ejecting head 22 may be disposed in the region of the home position HP of the carriage 21 inside the printing function section 13 and each main tank 30 may be disposed on a lower side of the maintenance section. In this way, it is possible to decrease a distance from each main tank 30 to the relay adapter AD.

The inside of the dam section 61 on the upper surface of the printing function section 13 may be inclined so as to descend toward the filling port 60. In this way, it is possible to guide the ink spilled from the filling port 60 into the dam section 61 to the filling port 60 by gravity.

The dam section 61 may be omitted.

A recessed section may be provided on the upper surface of the printing function section 13 so as to surround the filling port 60 instead of the dam section 61 and an inner surface of the recessed section may be the dam section.

The case is configured of one member (the printing function section 13) in the above embodiment, but may be configured of two or more members.

The sub-tank 50 may be disposed outside of the printing function section 13.

The filling port 60 may not necessarily be covered by the image reading section 14.

The filling port 60 may be covered by a cover member other than the image reading section 14.

The air communication section 54 of the main tank 30 may be omitted.

The air communication section 54 opening the inside of the sub-tank 50 to the atmosphere may be provided in the upper end portion of the sub-tank 50.

The air communication pipe 53 may be omitted.

The height of the upper end of the sub-tank 50 may be higher than the height of the main tank 30.

The connection pipe 62 may have a portion that is lower in the downstream side than in the upstream side of the ink.

The filling port 60 may not necessarily be disposed at a position higher than the main tank 30.

The buffer section 64 may be omitted.

The filling port 60 may be disposed in the front surface 13*a* of the printing function section 13. In this way, since the filling port 60 is disposed at a position close to the user, the user can easily fill the ink from the filling port 60.

The filling port 60 may not necessarily be disposed in the front end portion of the printing function section 13. That is, the filling port 60 may be disposed in a rear end portion or a side surface portion of the printing function section 13.

The filling port 60 may be disposed in the operation panel section 24 (inclined surface 24*a*). In this case, it is preferable that a cover member for opening and closing the filling port 60 be provided in the operation panel section 24 (inclined surface 24*a*).

The target may be fabric, a plastic film, a CD, and the like in addition to the paper sheet P.

In the above embodiments, the recording apparatus may be a fluid ejecting apparatus that performs recording by ejecting or discharging a fluid (including a liquid, a liquid body that is formed by dispersing or mixing particles of a functional material into a liquid, a fluid body such as a gel, and a solid that can be ejected to flow as a fluid) other than ink. For example, the recording apparatus may be a liquid body ejecting apparatus that performs recording by ejecting a liquid body containing a material of an electrode material, a color material (pixel material), and the like as a dispersed or dissolved form, which is used for manufacturing a liquid crystal display, an electroluminescence (EL) display, a surface emitting display, and the like. Furthermore, the recording apparatus may be a fluid body ejecting apparatus that ejects a fluid body such as a gel (for example, a physical gel). Then, it is possible to apply the invention to the fluid ejecting apparatus of any one of these types. In this specification, "fluid" is a concept not including a fluid composed of only gas and the fluid includes, for example, a liquid (including an inorganic solvent, an organic solvent, a solution, a liquid resin, a liquid metal (metallic melt), and the like), a liquid body, a fluid body, and the like.

The entire disclosure of Japanese Patent Application No. 2013-234196, filed Nov. 12, 2013 is expressly incorporated by reference herein.

What is claimed is:

1. A recording apparatus comprising:

a case;

a liquid ejecting head that performs recording by ejecting a liquid with respect to a target;

a first tank in which the liquid is stored and which connects to the liquid ejecting head, and a second tank which is connected to the first tank by way of an air communication pass and an ink communication pass, wherein the air communication pass connects with an inside of the first tank and an inside of the second tank at a position higher than a surface of the liquid.

2. The recording apparatus according to claim 1, further comprising a filling port for filling the liquid disposed in a front end portion of the case.

3. The recording apparatus according to claim 1, further comprising a filling port for filling the liquid disposed in a front side surface of the case.

4. The recording apparatus according to claim 1, wherein the first tank is provided with a replenishing port for replenishing the liquid, and the case includes a filling port, and wherein a connection section connects the filling port and the replenishing port.

5. The recording apparatus according to claim 1, wherein the case includes a filling port, and wherein a connection section connected to the filling port is provided with a buffer section that is capable of temporarily storing the liquid when filling the liquid from the filling port.

6. The recording apparatus according to claim 1, wherein the case includes a filling port disposed at a position higher than that of the first tank.

7. The recording apparatus according to claim 1, wherein the case includes a filling port that is connected to the first tank by a connection section, and wherein the connection section extends such that a downstream side thereof is lower than an upstream side.

8. The recording apparatus according to claim 1, wherein the second tank has a lower end whose height is equal to a height of a lower end of the first tank and a height of an upper end of the second tank is equal to or greater than a height of an upper end of the first tank and which is capable of storing the liquid, and wherein the lower end of the second tank communicates with the lower end of the first tank by way of the ink communication pass.

9. The recording apparatus according to claim 8, wherein an air communication section allowing the inside of the first tank to communicate with the atmosphere is provided in the upper end of the first tank, and wherein the first tank and the second tank communicate with each other, by way of the air communication pass, at a position higher than a liquid surface of the liquid inside thereof.

10. The recording apparatus according to claim 1, further comprising:

a filling port in the case; and a cover member that covers the filling port.

11. The recording apparatus according to claim 1, wherein the first tank is disposed in the case.

12. The recording apparatus according to claim 1, wherein the first tank is disposed so as to overlap a transportation path of the target in a height direction of the case in the case.

13. The recording apparatus according to claim 1, further comprising a filling port in the case, and wherein a dam section that retains liquid spilled from the filling port is provided in the case so as to surround the filling port.

14. The recording apparatus according to claim 13, wherein the first tank is laterally displaced with respect to the filling port.

15. The recording apparatus according to claim 1, wherein a remaining amount of the liquid inside the second tank may be visually recognized from the front side of the case through a viewing window formed in the case.

16. The recording apparatus according to claim 1, further comprising a filling port in the case, wherein the filling port is disposed in an inclined surface.

* * * * *